US006637217B2

(12) United States Patent
Kim et al.

(10) Patent No.: US 6,637,217 B2
(45) Date of Patent: Oct. 28, 2003

(54) ICE MAKER FOR REFRIGERATOR AND CONTROL METHOD THEREOF

(75) Inventors: Il Sin Kim, Changwon (KR); Si Yun An, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/026,810

(22) Filed: Dec. 27, 2001

(65) Prior Publication Data

US 2002/0083726 A1 Jul. 4, 2002

(30) Foreign Application Priority Data

Dec. 30, 2000 (KE) ..... 2000-0087395
Dec. 30, 2000 (KR) ..... 2000-0087392
Dec. 30, 2000 (KR) ..... 2000-0087393
Dec. 30, 2000 (KR) ..... 2000-0087394

(51) Int. Cl.[7] ..... F25B 49/00
(52) U.S. Cl. ..... 62/125; 62/137; 62/344; 62/353
(58) Field of Search ..... 62/125, 126, 127, 62/135, 137, 344, 353

(56) References Cited

U.S. PATENT DOCUMENTS 34,174 A * 1/1862 Brown et al. ..... 144/124
3,774,407 A * 11/1973 Bright ..... 62/353
3,779,032 A * 12/1973 Nichols ..... 62/233
4,424,683 A * 1/1984 Manson ..... 62/135
4,426,851 A * 1/1984 Neumann ..... 340/514
4,649,717 A * 3/1987 Tate et al. ..... 29/854
4,665,708 A * 5/1987 Tate et al. ..... 62/66
4,787,216 A * 11/1988 Chesnut et al. ..... 62/347
4,799,362 A * 1/1989 Chestnut ..... 62/127
4,866,948 A * 9/1989 Cole ..... 200/249
4,872,317 A * 10/1989 Reed ..... 62/135
5,160,094 A * 11/1992 Willis et al. ..... 62/137
5,329,786 A * 7/1994 Willis et al. ..... 62/353
5,408,834 A * 4/1995 Schlosser et al. ..... 62/303
5,768,899 A * 6/1998 Lee et al. ..... 62/137
6,351,955 B1 * 3/2002 Oltman et al. ..... 62/353

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

An ice maker of a refrigerator includes: an ice making vessel having a plurality of cavities; an ejector for separating ice formed in the cavity from the ice making vessel and discharging the ice to a storage container; a driving unit for driving the ejector; a heater disposed at a lower side of the ice making vessel and heating the ice making vessel; a temperature sensor disposed at one side of the ice making vessel and sensing a temperature of the ice making vessel; a full ice detecting unit for generating an electric signal when the storage container is full of ice; and a control unit for receiving the electric signal outputted from the full ice detecting unit and the temperature sensor so as to control an operation of the driving unit and the heater, and turning on/off an input power supply according to the electric signal outputted from the full ice detecting unit. Since the ice maker includes a control unit to control each driving element of the ice maker, the entire process that water is supplied to the ice maker vessel, ice making is performed and the ejector is operated to store the formed ice to the storage container, can be automatically controlled, the performance of the ice maker can be improved.

20 Claims, 6 Drawing Sheets

ICE MAKER FOR REFRIGERATOR AND CONTROL METHOD THEREOF

BACKGROUND OF THE INVENTION

1. Field of the Invention

The present invention relates to an ice maker of a refrigerator, and more particularly, to an ice maker of a refrigerator that is capable of automatically controlling the entire process from supplying water for making ice to separating the ice and storing it in a storage container, and its control method 2. Description of the Background Art In general, an ice maker is separately installed in a freezing instrument or a refrigerating instrument to make ice by using a cooling cycle provided in the freezing instrument and the refrigerating instrument.

FIG. 1 is a perspective view of an ice maker in accordance with a conventional art, and FIG. 2 Is a schematic view showing the construction of the ice maker in accordance with the conventional art.

The ice maker of the conventional art includes: an ice making vessel 102 mounted at a certain position for receiving cooling air of a refrigerator and having a plurality of partitions 110; an ejector 104 rotatably mounted at an upper side of the ice making vessel 102, separating ice formed by the ice making vessel and transferring the separated ice in a storage container (not shown); a driving motor 106 installed at one side of the ice making vessel 102 and rotating the ejector 104; a heater 108 installed at a lower side of the ice making vessel 102 and supplying heat to the ice making vessel to facilitate separation of ice formed by the ice making vessel 102; and a full ice detecting unit stopping the driving motor 106 when ice making vessel is full of ice.

The ice making vessel 102 includes a plurality of cavities divided by the partitions 110. A storage container (not shown) is disposed at the lower side of the ice making vessel 102 to store ice formed in the ice making vessel 102. A cup 112 is mounted at one side of the ice making vessel 102 to supply water to the cavities, and a control box 114 is mounted at the other side of the ice making vessel 102, having various parts for driving the ice maker such as the driving motor 106.

The driving motor 106 is fixed inside the control box 114, and a drive gear 116 is connected to the driving motor 106.

As the drive gear 116 is geared with a cam shaft 118 fixed at the ejector 104, a rotational force of the driving motor 106 is transferred to the ejector 104.

A thermostat 120 is mounted at one side of the ice making vessel 102 to sense a temperature inside the ice making vessel and turn on or turn off the heater 108 and the driving motor 106.

The thermostat 120 is formed as a bimetal type to turn on/off a power source applied to the heater 108 and the driving motor 106 according to a temperature of the ice making vessel 102.

An operating switch (not shown) is disposed at the cam shaft 118 to switch on/off a valve (not shown) installed at a supply passage for supplying water to the cup 112. That is, as the operating switch is turned on/off a power supply according to rotation of the cam shaft 118, the power source applied to the valve (not shown) is turned on/off so as to control water supply to the ice making vessel 102.

The full ice detecting unit includes a detecting lever 122 positioned at the storage container and rotatably mounted at the control box 114, and a detecting switch 124 connected to the detecting level 122 and turning off the ice maker when ice is full of the storage container according to rotation of the detecting lever 122.

That is, in the full ice detecting unit, when ice is full of the storage container, the detecting lever 122 is moved upwardly so as to be limited in its rotation movement, and accordingly, the detecting switch is turned off to cut off a power supply applied to the ice maker.

The operation of the ice maker of a refrigerator in accordance with the conventional art will now be described.

When water filled in each cavity of the ice making vessel 102 is frozen by cooling air supplied from a cooling system, the thermostat 120 senses a temperature of the ice making vessel and operates the heater 108.

Then, the heater 108 heats the ice making vessel to facilitate separation of ice formed in the ice making vessel 102.

When the temperature of the ice making vessel increases to a certain degree due to heating by the heater 108, the power supplied to the heater 108 is cut off by the operation of the thermostat 120 and a power supply is applied to the driving motor 106.

Then, the drive gear 116 is rotated according to driving of the driving motor 106, the cam shaft 118 geared with the drive gear 116 is rotated, the ejector 104 is rotated according to rotation of the cam shaft 118, so as to separate ice formed in the ice making vessel 102 and transfer the separated ice to the storage container disposed at a lower side of the ice making vessel 102.

When the cam shaft 118 is rotated, an operating switch (not shown) adjacent to the cam shaft 118 is turned on. As the operating switch is turned, on, the valve is operated to open a supply passage and then water is supplied to the ice making vessel 102 through the cup 112.

The water amount supplied to the ice making vessel 104 is determined by the interval of a cam formed at the cam shaft 118, a time during which the operating switch is maintained ON.

When the storage container is full of ice by the ice making operation, the detecting lever 122 is limited in its rotation due to the ice, and as the detecting switch 124 is turned off according to operation of the detecting lever 122, the operation of the ice maker is stopped.

However, the ice maker of a refrigerator in accordance with the conventional art constructed and operated as described above has many problems.

That is, first, since the supply time is determined by the rotation angle of the cam shaft, that is, the mechanical operation interval of the cam, and the water supply amount is accordingly determined, if an error occurs to the rotation of the cam shaft, water amount supplied to the ice making vessel differs, and thus, the size of ice is different and a defective occurrence rate is high.

Secondly, once the water supply amount is determined, it is not controllable anymore, the size of formed ice is not controllable.

Thirdly, after the ice making vessel is installed, it is not possible to determine a propriety of a water amount supplied to the ice making vessel.

Fourthly, since the thermostat for sensing a temperature of the ice making vessel is formed as a bi-metal type, it is difficult to accurately detect a temperature, and thus, an error occurs due to the thermostat and a defective proportion increases.

Fifthly, since there is no function for testing an operation state of the ice making vessel, it is not possible to recognize malfunction of the ice maker.

Lastly, since the conventional ice maker of a refrigerator does not have a structure for blocking circuit components installed in a case from moisture, a temperature difference takes place in a process that the door of the refrigerator is repeatedly opened and shut, and due to the temperature difference, the inside of the case is frozen or a water drop is generated. This would cause an electric leakage and a fire of the circuit components, resulting in a problem to an operation of the circuit components and that a normal controlling is not possible.

SUMMARY OF THE INVENTION

Therefore, a first object of the present invention is to provide an ice maker of a refrigerator that is capable of automatically controlling the entire process of supplying water to an ice making vessel, operating an ejector after completion of ice making and storing the formed ice in a storage container by having a control system for automatically controlling each driving element of an ice maker, and its control method.

A second object of the present invention is to provide an ice maker of a refrigerator that is capable of controlling a size of ice formed by controlling an amount of water supplied to an ice making vessel according to a user's selection, and its control method.

A third object of the present invention is to provide an ice maker of a refrigerator that is capable of reducing an operation error and improving a performance by adopting a thermistor type temperature sensor for detecting a temperature of an ice making vessel, and its control method.

A fourth object of the present invention is to provide an ice maker of a refrigerator that is capable of preventing a deficiency due to water introduced into circuit components by molding various circuit components controlling an ice maker to block water from being introduced into the circuit components, and its control method.

A fifth object of the present invention is to provide an ice maker of a refrigerator that is capable of preventing a damage to circuit components due to cooling air generated due to an ice making operation by constantly maintaining a temperature inside a control box to which the circuit components are inserted, and its control method.

A sixth object of the present invention is to provide an ice maker of a refrigerator that is capable of preventing occurrence of deficiency in advance by recognizing whether each element of an ice maker is normally operated before an ice making operation or after installation of an ice maker, and its control method.

To achieve these and other advantages and in accordance with the purpose of the present invention, as embodied and broadly described herein, there is provided an ice maker of a refrigerator including: an ice making vessel having a plurality of cavities; an ejector for separating ice formed in the cavity from the ice making vessel and discharging the ice to a storage container; a driving unit for driving the ejector; a heater disposed at a lower side of the ice making vessel and heating the ice making vessel; a temperature sensor disposed at one side of the ice making vessel and sensing a temperature of the ice making vessel; a full ice detecting unit for generating an electric signal when the storage container is full of ice; and a control unit for receiving the electric signal outputted from the full ice detecting unit and the temperature sensor so as to control an operation of the driving unit and the heater, and turning on/off an input power supply according to the electric signal outputted from the full ice detecting unit.

In the ice maker of a refrigerator of the present invention, the ice making vessel having a plurality of cavities separated by partitions includes a water supply unit installed to supply water into the cavities at one side and a control box having the control unit and the driving unit installed at the other side thereof.

In the ice maker of a refrigerator of the present invention, the water supply unit includes a cup connected to the cavity of the ice making vessel, a water supply tube connected to the cup and supplying water to the cup, and a open-and-shut valve installed at one side of the water supply tube and performs a switching operation on the water supply tube.

In the ice maker of a refrigerator of the present invention, the open-and-shut valve is formed as a solenoid type which opens the water supply tube when a power supply is applied thereto.

In the ice maker of an refrigerator of the present invention, the control box includes a plate having the ejector rotatably disposed and the driving unit and a case for receiving various circuit components of the ice maker, and a display panel is installed at a front side thereof.

In the ice maker of an refrigerator of the present invention, the circuit components inserted into the control box is molded so as to cut off water from being introduced thereto from outside.

In the ice maker of a refrigerator of the present invention, the driving unit includes a driving motor fixed at the plate and generating a rotational force; a driving gear connected to the rotational shaft of the driving motor; and a driven gear connected to the rotational shaft of the ejector and being geared with the driving gear.

In the ice maker of an refrigerator of the present invention, the temperature sensor is formed as a thermistor type so that its electric resistance value is varied according to a temperature change of the ice making vessel and a corresponding electric signal is applied to the control unit.

In the ice maker of a refrigerator of the present invention, the full ice detecting unit includes a sensing bar rotatably connected to the plate and positioned at the storage container so as to be rotated as the storage container is full of ice; and a magnet switch having a first magnet mounted at a tip portion of the sensing bar and a second magnet installed at one side of the driven gear and applying an electric signal to the control unit when the first magnet and the second magnet are positioned on a straight line according to the rotation of the sensing bar.

In the ice maker of a refrigerator of the present invention further includes an ice size controlling unit for controlling a size of ice formed in the cavities of the ice making vessel.

In the ice maker of a refrigerator of the present invention, the ice size controlling unit includes a control lever installed at the display panel and operated to select a size of ice by a user; and a control unit for controlling an opening time of the switch valve of the water supply unit according to an electric signal applied from the control lever.

To achieve the above object, there is also provided an ice maker of a refrigerator including: an ice making vessel having a plurality of cavities; an ejector for separating ice formed in the cavity from the ice making vessel and discharging the ice to a storage container; a driving unit for driving the ejector; a temperature sensor disposed at one side of the ice making vessel and sensing a temperature of the ice making vessel; a control box disposed at one side of the ice making vessel and storing the driving unit and various circuit components; and a temperature maintaining unit installed at the control box and constantly maintaining a temperature inside the control box to prevent a damage to the circuit components due to cooling air generated according to an ice making operation.

In the ice maker of a refrigerator of the present invention, the temperature maintaining unit includes a heater installed inside the control box and heating circuit components to a certain temperature; a temperature sensor installed inside the control box and detecting a temperature of the circuit components; and a control unit operating the heater according to an electric signal applied from the temperature sensor.

To achieve the above object, there is also provided an ice maker of a refrigerator including: an ice maker of a refrigerator including: an ice making vessel having a plurality of cavities; an ejector for separating ice formed in the cavity from the ice making vessel and discharging the ice to a storage container; a driving unit for driving the ejector; a temperature sensor disposed at one side of the ice making vessel and sensing a temperature of the ice making vessel; a display panel installed at a front side of the ice making vessel and displaying an ice making operation; a water supply unit supplying water to the cavities; and a test unit informing a user whether each element of the ice maker is normally operated.

In the ice maker of a refrigerator of the present invention, the test unit includes a test button installed at one side of the display panel and being operated by a user; a control unit performing a testing on each element when the test button is operated; an informing unit for informing the user of a defective element; and a locating sensor installed at one side of the driving unit and detecting a rotational position of the driving unit.

In the ice maker of a refrigerator of the present invention, the informing unit is installed at the display panel and includes a plurality of warning lamps prepared by each element, so that a warning lamp corresponding to a defective element blinks.

In the ice maker of a refrigerator of the present invention, the locating sensor is installed at one side of the driving unit and formed as a magnet switch type so as to apply an electric signal to the control unit when the rotational position of the driving unit is accurately aligned.

To achieve the above objects, there is further provided a control method of an ice maker of a refrigerator including: a first step in which a power switch is turned on and a switch valve is opened to supply water to an ice making vessel; a second step in which an opening time of the switch valve reaches a pre-set value; a third step in which the switch valve is turned off and an ice making operation is performed, if it is determined that the opening time of the open-and-shut valve has reached a pre-set time; a fourth step in which it is determined that a temperature of the ice making vessel has reached a pre-set value; a fifth step in which a heater is turned on if it is determined that the temperature of the ice making vessel has reached a pre-set value; a sixth step in which a driving motor is driven when a certain time elapses after the heater is operated; and a seventh step in which the power switch is turned off if a storage container is full of ice.

In the control method of an ice maker of a refrigerator of the present invention, the second step includes a step in which a user selects a size of ice, and a step in which an opening time of the open-and-shut valve is controlled as the size of ice is selected.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of an ice maker of a refrigerator and its control method of the present invention, and the most preferred one will now be described.

Figure 1:
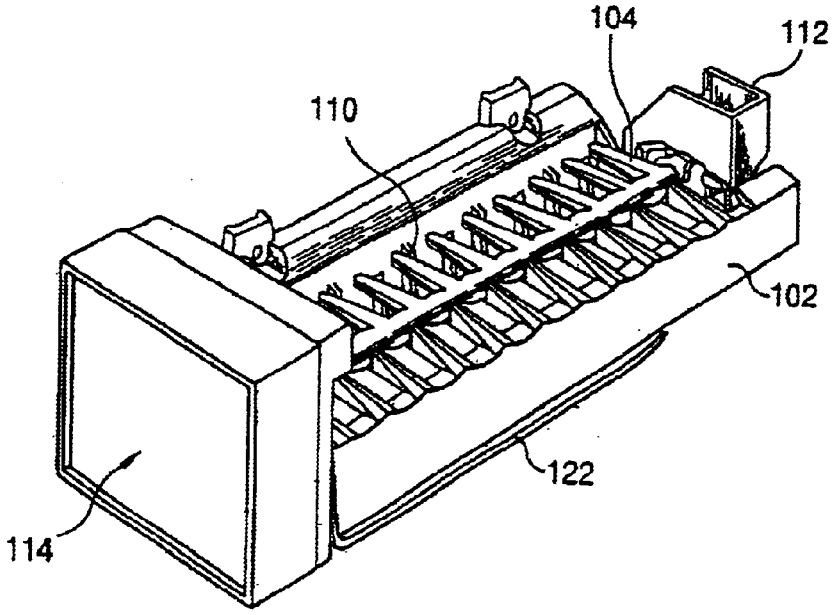
FIG.1 CONVENTIONAL ART
FIG. 1 is a perspective view of an ice maker of a refrigerator in accordance with a conventional aft.
Figure 2:
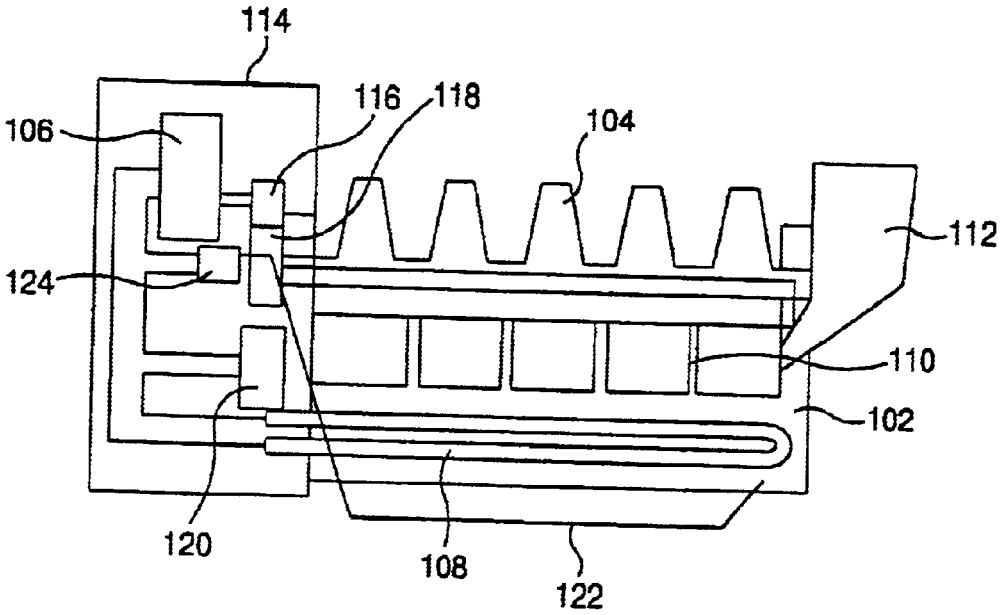
FIG.2 CONVENTIONAL ART
FIG. 2 is a schematic sectional view of the ice maker of a refrigerator in accordance with the conventional art.
Figure 3:
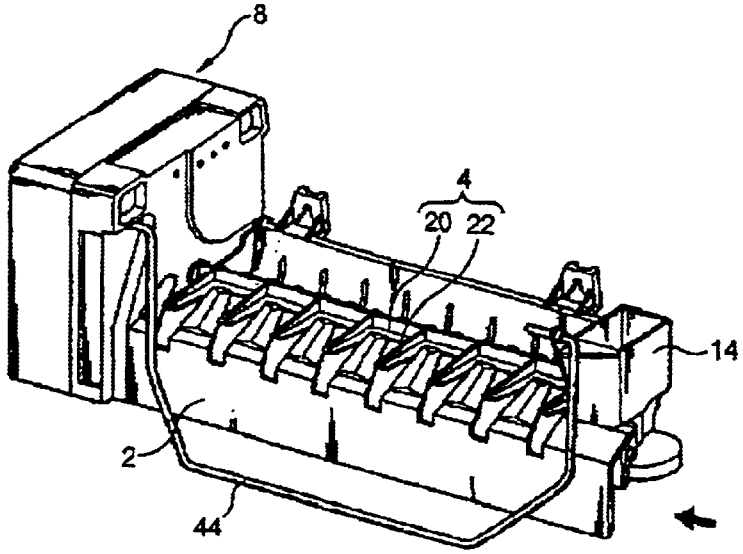
FIG. 3 is a perspective view of an ice maker of a refrigerator in accordance with a first embodiment of the present invention.
Figure 4:
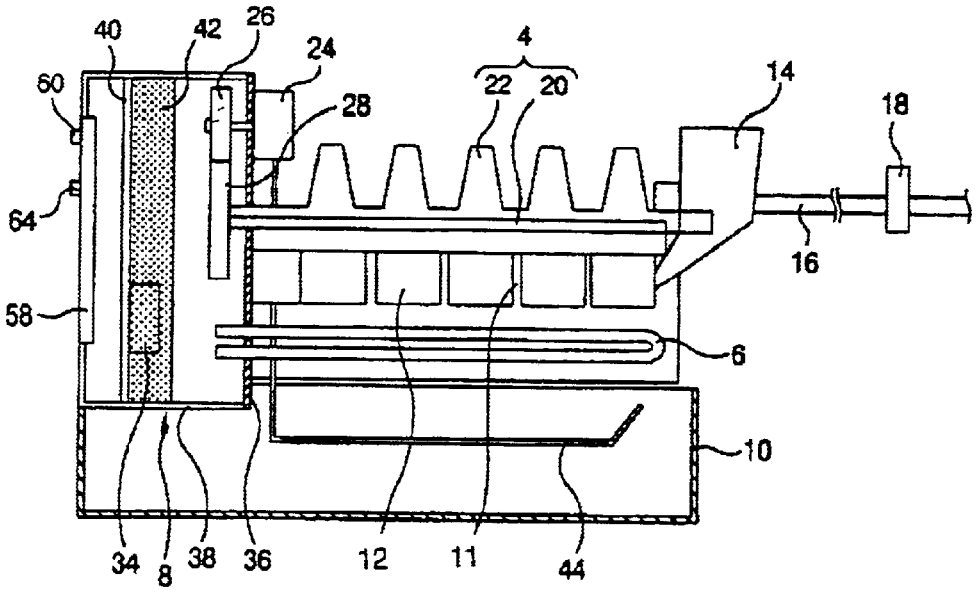
FIG. 4 is a schematic sectional view of the ice maker of a refrigerator in accordance with the first embodiment of the present invention.

FIG. 3 is a perspective view of an ice maker of a refrigerator in accordance with a first embodiment of the present invention, and FIG. 4 is a schematic sectional view of the ice maker of a refrigerator in accordance with the first embodiment of the present invention.

An ice maker of a refrigerator of the present invention includes: an ice making vessel 2 having a plurality of cavities 12 separated by partitions 11; an ejector 4 rotatably installed at an upper side of the ice making vessel 2 and separating the formed ice from the ice making vessel 2; a driving unit installed at one side of the ice making vessel 4 and rotating an ejector 4; a heater 6 installed at a lower side of the ice making vessel 2 and heating the ice making vessel 2 to facilitate separation of the formed ice; and a controlling unit for controlling an operation of the ice maker.

Referring to the ice making vessel 2, the plurality of cavities, the space where ice is formed, are formed in a longitudinal direction, and a water supply unit is connected to one end portion thereof to supply water to the cavity 12 and a control box having the driving unit and the controlling unit 8 is mounted at the other end portion thereof, and a storage container 10 is mounted at a lower side of the ice making vessel 2 to store formed ice.

The water supply unit includes a cup 14 provided as a space to which water is introduced at one side of the ice making vessel 2, a water supply tube 16 connected between the cup 14 and an outside and supplying water; and a open-and-shut valve 18 installed at one side of the water supply tube 16 and performing a switching operation on the water supply tube 16.

The open-and-shut valve 18 preferably adopts a solenoid method so that when the power is turned on, the water supply tube 16 is opened, while when the power is turned off, the water supply tube is shut.

The ejector 4 includes a hinge shaft 20 rotatably mounted in the longitudinal direction of the ice making vessel 2, and a scripper 22 formed in the longitudinal direction of the hinge shaft 20 and pulling out ice formed in the cavities 12 and discharging the ice to the storage container 10.

The driving unit includes: a driving motor 24 mounted at the control box 8 and generating a driving force when a power is applied thereto, a driving gear 26 connected to the driving motor 24 and being rotated together; and a driven gear 28 connected to the hinge shaft 20 of the ejector 4 and being geared with the driving gear 24.

The heater 6 is disposed at a bottom of the ice making vessel 2 and is preferably formed as a bar type heated as a power is applied thereto.

Figure 5:
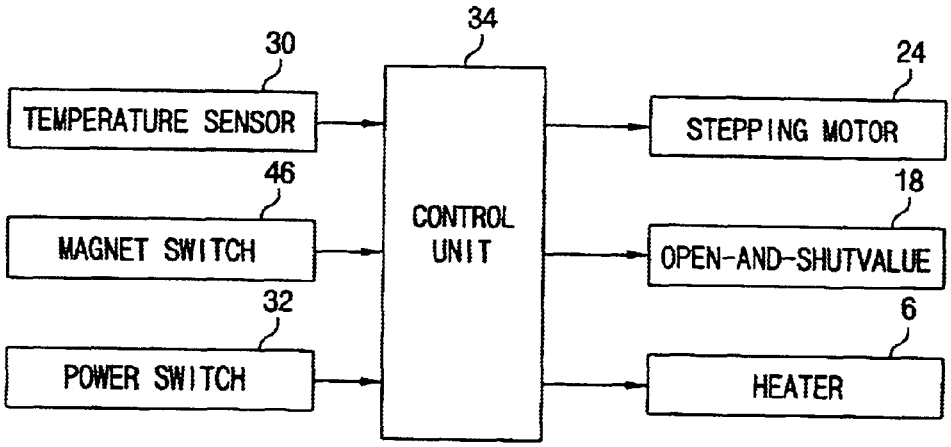
FIG. 5 is a schematic block diagram of a controlling unit of the ice maker of a refrigerator in accordance with the first embodiment of the present invention.

As shown in FIG. 5, the controlling unit includes a full ice detecting unit installed at the storage container 10 and generating an electric signal when the storage container 10 is full of ice; a temperature sensor 30 disposed at one side of the ice making vessel 2 and sensing a temperature of the ice making vessel 2; a power switch 32 installed at the control box 8 and switching on/off the ice maker; and a control unit operating the driving unit, the heater or the open-and-shut valve upon receipt of an electric signal of the temperature sensor 30 and the power switch 32.

The control box 8 includes a plate 36 at which the hinge shaft of the ejector 4 is rotatably mounted and the driving motor 24 is fixed, and a case 38 where a PCB 50 having the circuit components such as the control unit 34 mounted thereon is mounted.

Since various circuit components which are sensitive to moisture are mounted on the PCB 40, the PCB 40 is molded at its outer side to prevent infiltration of moisture.

That is, the outer side 42 of the PCB 40 is molded in a state that the PCB 40 is inserted in the case 38, so that electric leakage is prevented due to water introduced into the cavity 12 when the ice maker is operated.

Figure 6:
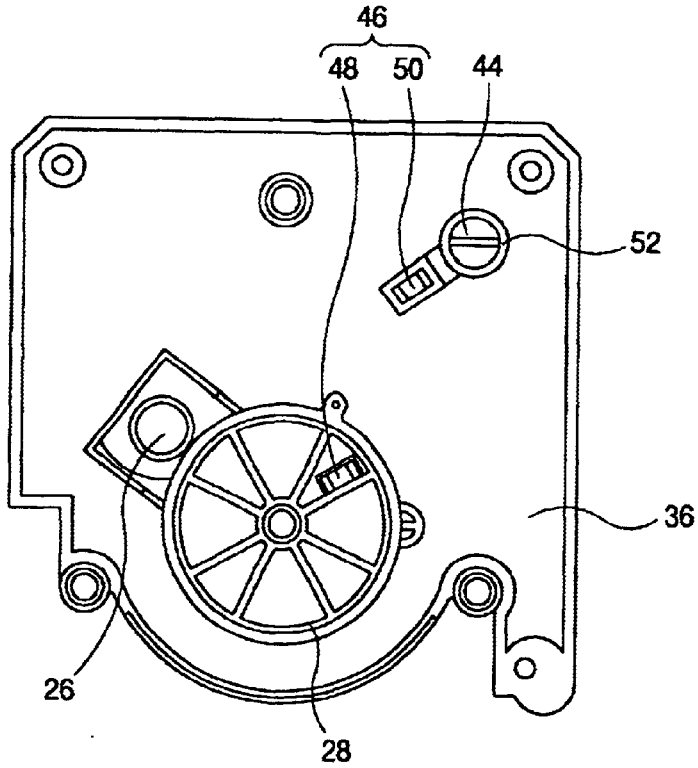
FIG. 6 is a front view of a driving unit of ice maker of a refrigerator in accordance with the first embodiment of the present invention.

As shown in FIG. 6, the full ice detecting unit includes a sensing bar 44 rotatably mounted at one side of the plate 36 and positioned at the storage container 10 and rotated as the storage container is filled with ice; and a magnet switch 46 connected to the end portion of the sensing bar 44 and applying an electric signal to the control unit 34 according to movement of the sensing bar 44 when the storage container 10 is full of ice.

The magnet switch 46 includes a first magnet 48 mounted at one side of the driven gear 28 which is connected to the ejector 4 and rotated, and a second magnet 50 mounted at one side of the magnet holder 52 which is mounted at the sensing bar 44, so that when the first magnet and the second magnet 50 are positioned at on a straight line as the sensing bar 44 is rotated, an electric signal is applied to the control unit 34.

The temperature sensor 30 senses a temperature of the ice making vessel and applies an electric signal to the control unit, and is formed as a thermistor type so that an electric resistance value is varied according to a temperature change of the ice making vessel and a corresponding electric signal is applied.

The control method of a ice maker of a refrigerator of the present invention will now be described.

Figure 7:
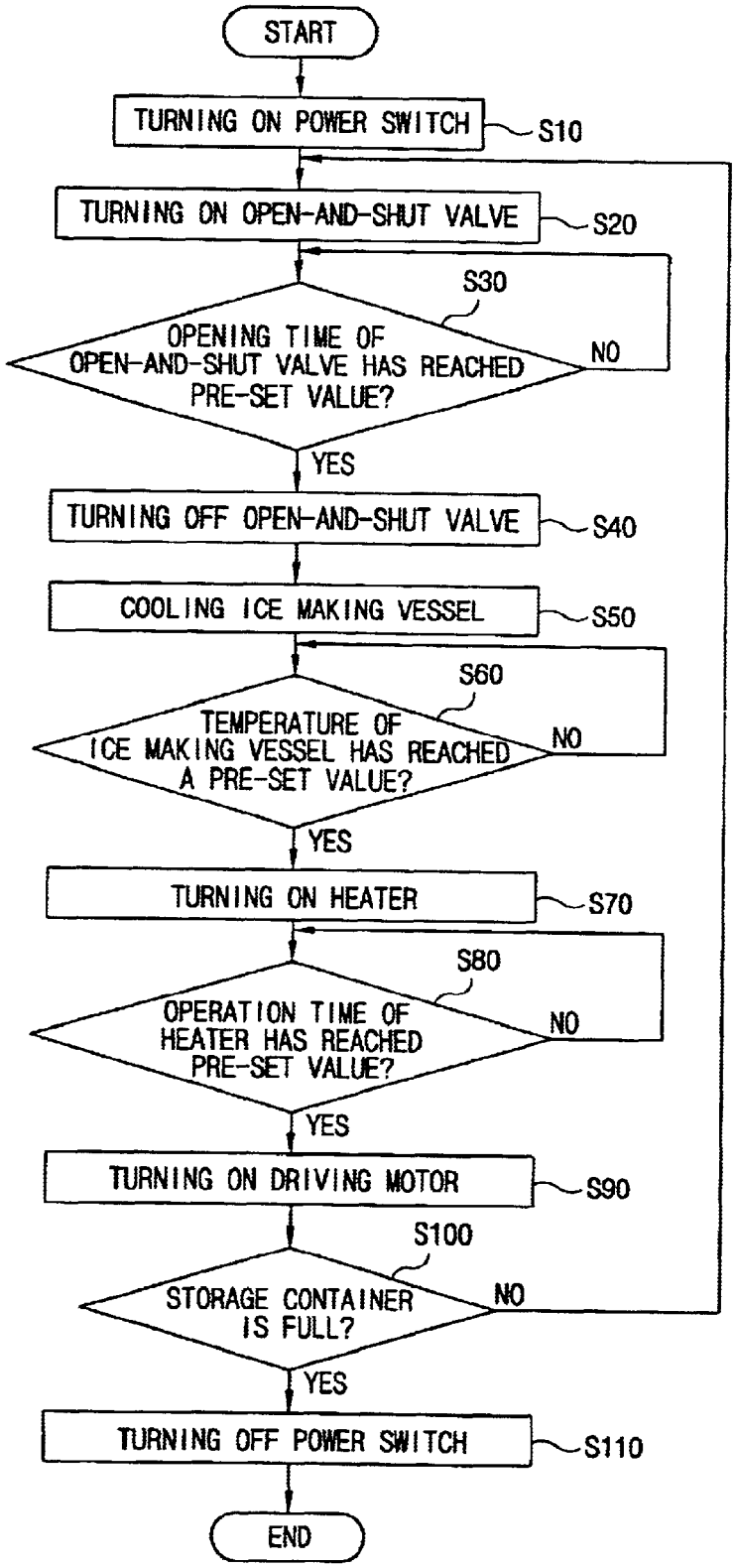
FIG. 7 is a flow chart of a control method of ice maker of a refrigerator in accordance with the first embodiment of the present invention.

FIG. 7 is a flow chart of a control method of ice maker of a refrigerator in accordance with the first embodiment of the present invention.

An operation of the ice maker of a refrigerator of the present invention will now be described.

First, when the power switch 32 is turned on, a power is supplied to the ice maker, and the open-and-shut valve 18 is turned on according to the electric signal of the control unit 34 (steps S10, S20).

That is, when the power is applied to the open-and-shut valve 18, the open-and-shut valve 18 is operated to open the water supply tube 16, so that water can be supplied to each cavity 12.

After the open-and-shut valve 18 is opened, the elapsed time and a preset value are compared to each other. If it is determined that the opening time has reached a pre-set value, the open-and-shut valve 18 is turned off (steps S30, S40).

The pre-set value signifies a value set according to the size of ice by the user. That is, the amount of water supply filled in the cavity 12 differs depending on time take to supply water, and accordingly, a corresponding size of ice differs.

When the open-and-shut valve 18 is turned off, an ice making operation is performed on the water filled in the cavity 12 starts to be frozen according to the freezing system (step S50).

After the ice making operation of the ice making vessel 2 is performed, when a certain time period elapses, it is determined whether ice making has been completed. If the ice making is determined to be completed, the heater 6 is turned on (steps S60, S70).

That is, when the temperature sensor 30 mounted at one side of the ice making vessel 2 applies an electric signal to the control unit 34, the control unit 34 compares a signal value applied from the temperature sensor 30 and a pre-set value. If the signal value is beyond the pre-set value, the control unit recognizes that ice making has been completed and operates the heater 6 for a certain time to heat the ice making vessel 2.

Then, since the ice formed in the ice making vessel 2 is separated from the ice making vessel 2, ice separation can be easily performed.

When the heating operation by the heater 6 is completed, the driving unit is operated to rotate the ejector 4 (steps S80, S90).

In detail, after the control unit 34 counts the heating time of the heater 6, if the control unit 34 determines that a pre-set time has elapsed, it turns off the heater 6 and drives the driving motor 24.

Then, the driving gear 26 connected to the driving motor is rotated, the driven gear 28 geared with the driving gear 26 is rotated, and the ejector 4 connected to the driven gear 28 is rotated, and accordingly, the scripper 22 of the ejector 4 is rotated to separate the ice from the cavities 12 and discharge the separated iced to the storage container 10.

As the ice is discharged to the storage container 10, it is determined whether the storage container is full of ice (step S100).

If the storage container 10 is determined to be not full of ice, the open-and-shut valve 18 is turned on to supply water into the cavities 12 and the ice making operation as described above is repeatedly performed.

If the storage container 10 is determined to be full of ice, the power switch 32 is turned off (step S110).

That is, when the storage container 10 is full of ice according to the operation of the ejector 4, the sensing bar 44 is rotated, according to which when the first magnet 48 and the second magnet 50 of the magnetic switch are positioned on a straight line, an electric signal is transmitted to the control unit 34.

Then, the control unit 34 turns off the power switch to stop operation of the ice maker.

Figure 8:
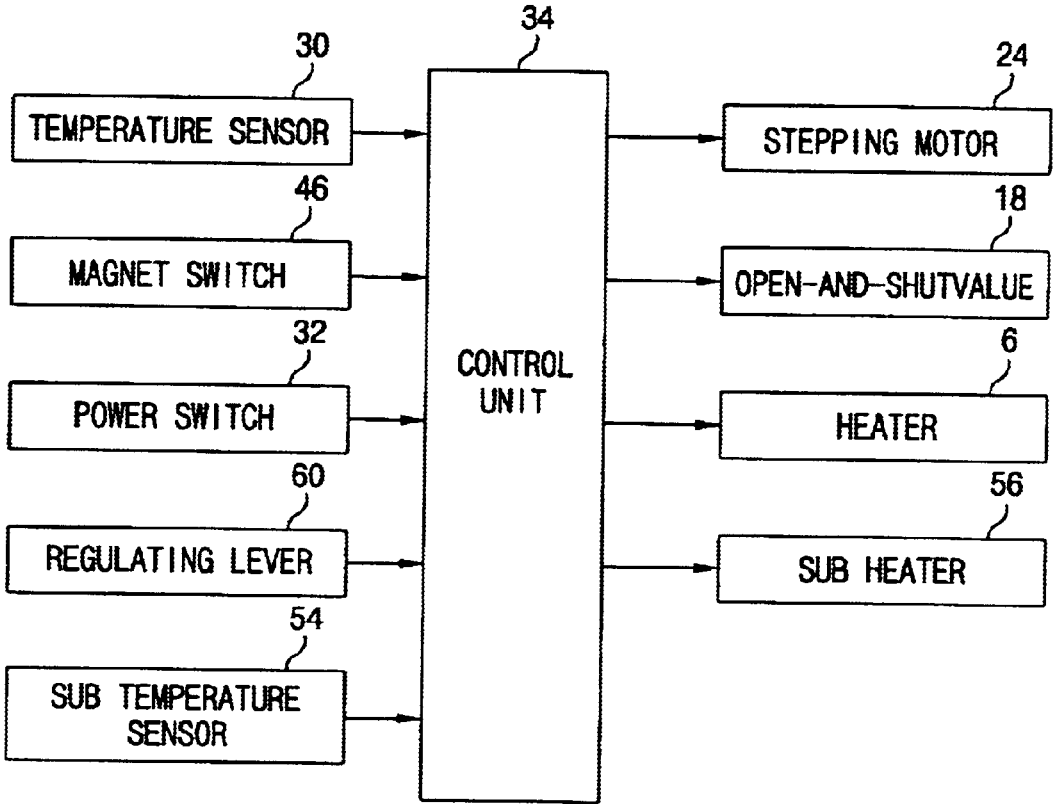
FIG. 8 is a schematic block diagram of a controlling unit of the ice maker of a refrigerator in accordance with a second embodiment of the present invention.

FIG. 8 is a schematic block diagram of a controlling unit of the ice maker of a refrigerator in accordance with a second embodiment of the present invention.

With reference to FIGS. 4 and 8, an ice maker of a refrigerator in accordance with a second embodiment of the present invention includes, in addition to the ice maker in accordance with the first embodiment of the present invention, an ice size controlling unit for controlling an amount of water supplied to the ice making vessel to control a size of ice; and a temperature maintaining unit for constantly maintaining a temperature of the circuit components so that various circuit components inserted in the control box 8 are not influenced by cooling air generated in the ice making operation.

In more detail, the ice size controlling unit includes a display panel 58 disposed at a front side of the control box 8 to display the current situation of the ice maker and having various operating buttons installed to be operated by a user to control the ice maker; a control lever 60 installed at one side of the display panel 58 and being operated by the user to control the size of ice; and a control unit 34 for controlling an opening time of the open-and-shut valve 18 when an electric signal is inputted according to manipulation of the control lever 60.

In the ice size controlling unit, when the user operates the control lever 60 to select a size of ice, a corresponding electric signal is applied to the control unit 34, and then, the control unit 34 controls an opening time of the open-and-shut valve 18 according to the electric signal applied from the control lever 60.

Then, the amount of water supplied to each cavity 12 of the ice making vessel through the water supply tube 16 is controlled and the size of the ice to be formed is accordingly controlled.

The temperature maintaining unit includes an auxiliary heater 56 for heating the circuit components mounted on the PCB 40 inside the control box 8 to a certain temperature; and an auxiliary temperature sensor 54 installed inside the control box 8 to sense a temperature of the circuit components and apply an electric signal to the control unit 34.

In the temperature maintaining unit, when the auxiliary temperature sensor 54 senses a temperature of the circuit components and applies the sensed temperature to the control unit 34, the control unit 34 compares the signal value applied from the auxiliary temperature sensor 54 and a pre-set value. If the signal value applied from the auxiliary temperature sensor 54 is determined to be lower than the pre-set value, the control unit 34 operates the auxiliary heater 56 to heat the circuit components.

When the circuit components are heated to reach a certain temperature, the process of turning off the operation of the auxiliary heater 56 is repeatedly performed so that the temperature of the circuit components are constantly maintained.

Figure 9:
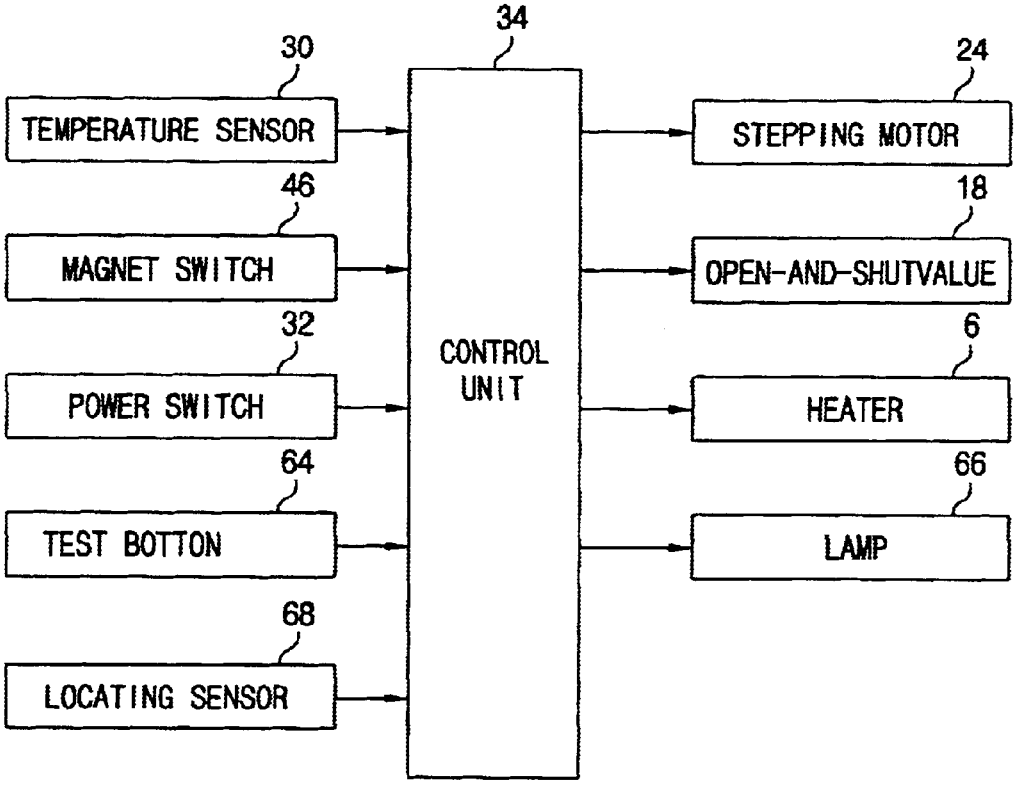
FIG. 9 is a schematic block diagram of a controlling unit of the ice maker of a refrigerator in accordance with a third embodiment of the present invention.

FIG. 9 is a schematic block diagram of a controlling unit of the ice maker of a refrigerator in accordance with a third embodiment of the present invention.

An ice maker in accordance with the third embodiment of the present invention includes, in addition to the ice maker in accordance with the first embodiment of the present invention, a test unit for recognizing whether each element is normally operated at an initial state of installation of the ice maker or before the ice maker is normally driven.

In detail, with reference to FIGS. 4 and 9, the test unit of an ice maker in accordance with the third embodiment of the present invention includes a test button 64 installed at one side of the display panel 58 and being manipulated by a user; a control unit 34 for performing a testing on each element as the test button is manipulated; and an informing unit for informing the user of a defect when each element is determined to be defective according to the signal applied from the control unit 34.

The informing unit is installed at the display panel 58 and includes a lamp 66 prepared by each element, so that a lamp corresponding to a deflective element blinks for user's information.

The operation of the testing function of the ice maker will now be described.

When the user manipulates the test button 64 to recognize whether each element is normally operated, the control unit 34 sequentially tests each element according to a signal of the test button 64.

First, the control unit 34 supplies a power to the heater 64 to determine whether the heater 6 is normally operated. That is, when a power is supplied to the heater 6 and the heater 6 is normally operated, the ice making vessel is heated. Then, the temperature sensor 30 applies an electric signal to the control unit 34. Upon receipt of the electric signal, the control unit 34 determines whether the heater 6 is being normally operated. If the heater is determined to be defective, the control unit 34 blinks the lamp 66 corresponding to the heater for user's information.

And the control unit 34 rotates the driving motor 24 by one time and determines whether the driving motor 24 is aligned at a home position. That is, the control unit 34 applies a power to the driving motor 24 to rotate the driving motor 24, and determines whether the driving motor 24 receives the electric signal from a locating sensor 68 mounted at one side of the driving gear 26 and the driven gear 28 and is rotated accurately by one time and aligned at a home position.

The locating sensor 68, formed as a magnet switch type, is mounted at one side the driving gear 26 and the driven gear 28 and applies an electric signal to the control unit 34 when the rotational position of the driving gear 26 and the driven gear 28 is precisely aligned.

If the driving motor 24 is determined to be defective, the lamp 66 corresponding to the driving motor 24 blinks for user's information.

And the control unit 34 determines whether water supply to the ice making vessel 2 is normally performed. That is, the control unit 34 operates the open-and-shut valve 18 to open the water supply tube 16, and then, when a certain time elapses, the control unit 34 determines whether the water supply is normally performed according to the electric signal applied from the temperature sensor 30 installed in the ice making vessel.

If the water supply to the ice making vessel 2 is normally performed, the temperature of the ice making vessel 2 which has been in a room temperature drops due to the water supply. If, however, there is no water supply, a temperature of the ice making vessel 2 is maintained at a room temperature if the water supply is determined to be defective, the lamp 66 blinks for user's information.

As so far described, the ice maker of a refrigerator of the present invention has many advantages.

That is, for example, first, since the ice maker includes a control unit to control each driving element of the ice maker, the entire process that water is supplied to the ice maker vessel, ice making is performed and the ejector is operated to store the formed ice to the storage container, can be automatically controlled, the performance of the ice maker can be improved.

Secondly, an amount of the water supplied to the ice making vessel can be controlled to control the size of ice to be formed according to a user's selection.

Thirdly, since the temperature sensor for detecting a temperature of the ice making vessel is formed as a thermistor type, the performance can be improved and the temperature can be precisely measured.

Fourthly, since various circuit components such as the control unit are molded to cut off water from being introduced to the circuit components, a defective due to possible water inflow can be prevented.

Fifthly, since the temperature sensor and the heater is installed in the control box with the circuit components therein, the temperature inside the control box is constantly maintained. Thus, a damage to the circuit components due to cooling air generated in the ice making operation can be prevented.

Lastly, since it is recognizable whether each element of the ice maker is normally operated before the ice making operation or after installation of the ice maker, defect occurrence can be prevented in advance.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An ice maker of a refrigerator, comprising:

an ice making vessel having a plurality of cavities;

an ejector configured to separate ice formed in the cavities from the ice making vessel and discharge the ice to a storage container;

a driver configured to drive the ejector;

a heater disposed at the ice making vessel configured to heat the ice making vessel;

a temperature sensor disposed at the ice making vessel configured to sense a temperature of the ice making vessel and generate a corresponding electric signal;

a full ice detector configured to generate an electric signal when the storage container is full of ice, comprising a rotatable sensing bar positioned adjacent a storage container for the ice maker configured to be rotated as the storage container fills with ice, and a magnet switch having a first magnet mounted at a tip portion of the sensing bar and a second magnet installed at one side of the driver, the magnet switch configured to generate an electric signal when the first magnet and the second magnet are positioned on a straight line according to the rotation of the sensing bar; and a controller configured to receive the electric signal outputted from the temperature sensor so as to control an operation of the driving means and the heater, and to receive the electric signal outputted from the full ice detecting means for turning on/off an input power supply.

2. The ice maker of claim 1, wherein the plurality of cavities of the ice making vessel are separated by partitions and the ice making vessel further comprises a water supply apparatus configured to supply water into the cavities at one side and a control box having the controller and the driver installed therein at the other side thereof.

3. The ice maker of claim 2, wherein the water supply apparatus comprises:

a cup connected to the cavities of the ice making vessel;

a water supply tube connected to the cup configured to supply water to the cup; and an open-and-shut valve installed at one side of the water supply tube configured to perform a switching operation on the water supply tube.

4. The ice maker of claim 3, wherein the open-and-shut valve comprises a solenoid type valve configured to open the water supply tube when a power supply is applied thereto.

5. The ice maker of claim 2, wherein the control box comprises:

a plate having the ejector rotatably disposed and the driver mounted therein; and a case configured to receive various circuit components of the ice maker therein; and a display panel installed at a front side of the case.

6. The ice maker of claim 5, wherein the circuit components are molded so as to prevent water from being introduced into the control box from outside.

7. The ice maker of claim 1, wherein the driver comprises:

a driving motor fixed to the plate and configured to generate a rotational force;

a driving gear connected to the rotational shaft of the driving motor; and a driven gear connected to the rotational shaft of the ejector and geared with the driving gear.

8. The ice maker of claim 1, wherein the temperature sensor comprises a thermistor type sensor, wherein the electric resistance value of the sensor is varied according to a temperature change of the ice making vessel and a corresponding electric signal is applied to the control means.

9. The ice maker of claim 1, further comprising an ice size controller configured to control a size of ice formed in the cavities of the ice making vessel.

10. The ice maker of claim 9, wherein the ice size controller comprises:

a control lever installed on the display panel and configured to be operated by a user to select a size of ice; and a controller configured to control an opening time of the switch valve of the water supply apparatus according to an electric signal applied from the control lever.

11. The ice maker of claim 1, further comprising:

a control box disposed at one side of the ice making vessel for storing the driving means and various circuit components; and a temperature maintaining means installed at the control box for constantly maintaining a temperature inside the control box to prevent damage to the circuit components due to cooling air generated by an ice making operation.

12. The icemaker of claim 11, wherein the temperature maintaining means comprises:

a heater installed inside the control box for heating circuit components to a certain temperature;

a temperature sensor installed inside the control box for detecting a temperature of the circuit components; and a control means for operating the heater according to an electric signal applied from the temperature sensor.

13. The ice maker of claim 1, further comprising:

a control box disposed at one side of the ice-making vessel for storing the driving means and various circuit components therein;

a display panel installed at a front side of the control box for displaying an ice making operation;

a temperature maintaining means installed at the control box for constantly maintaining a temperature inside the control box to prevent damage to the circuit components due to cooling air generated by an ice making operation; and a test means for informing a user whether each element of the icemaker is operating normally.

14. The ice maker of claim 1, wherein the controller is configured to measure an elapsed operation time of the heater compare the elapsed operation time to a preset value, and activate the driver when the elapsed operation time reaches the preset value.

15. An ice maker of a refrigerator, comprising:

an ice making vessel having a plurality of cavities;

an ejector configured to separate ice formed in the cavity from the ice making vessel and discharge the ice to a storage container;

a driver configured to drive the ejector;

a temperature sensor disposed at the ice making vessel and configured to sense a temperature of the ice making vessel;

a full ice detector configured to generate an electric signal when the storage container is full of ice, comprising a rotatable sensing bar positioned adjacent a storage container for the ice maker configured to be rotated as the storage container fills with ice, and a magnet switch having a first magnet mounted at a tip portion of the sensing bar and a second magnet installed at one side of the driver, the magnet switch configured to generate an electric signal when the first magnet and the second magnet are positioned on a straight line according to the rotation of the sensing bar;

a display panel permanently installed at a front side of the ice making vessel and configured to display an ice making operation;

a water supply apparatus configured to supply water to the cavities; and a tester configured to inform a user via the display panel whether each element of the ice maker is operating normally.

16. The ice maker of claim 15 wherein the tester comprises:

a test button installed at one side of the display panel and configured to be operated by a user;

a controller configured to perform a test on each element when the test button is operated by a user;

an informer configured to inform the user of a defective element; and a locating sensor installed at one side of the driver and configured to detect a rotational position of the driving means.

17. The ice maker of claim 16, wherein the informer is installed at the display panel and includes a plurality of warning lamps, one for each element, so that a warning lamp corresponding to a defective element blinks.

18. The ice maker of claim 16, wherein the locating sensor is installed at one side of the driving means and comprises a magnet switch type sensor configured to apply an electric signal to the controller when the rotational position of the driving means is accurately aligned.

19. An ice maker for a refrigerator, comprising:

an ice making vessel having a plurality of cavities of a prescribed shape;

a full ice detector configured to generate an electric signal when the storage container is full of ice, comprising a rotatable sensing bar positioned adjacent a storage container for the ice maker configured to be rotated as the storage container fills with ice, and a magnet switch having a first magnet mounted at a tip portion of the sensing bar and a second magnet installed at one side of the driver, the magnet switch configured to generate an electric signal when the first magnet and the second magnet are positioned on a straight line according to the rotation of the sensing bar; and an ice size controller configured and located near the ice making vessel to control an amount of water supplied to the plurality of cavities, thereby controlling a size of ice formed in the plurality of cavities based on the amount of water supplied thereto.

20. An ice maker of a refrigerator, comprising:

an ice making vessel having a plurality of cavities;

an ejector configured to separate ice from the cavities and discharge the ice to a storage container;

a driver configured to drive the ejector:

a heater disposed at the ice making vessel configured to heat the ice making vessel;

a temperature sensor disposed at the ice making vessel configured to sense a temperature of the ice making vessel and generate a corresponding electric signal;

a full ice detector configured to generate an electric signal when the storage container is full of ice;

a control box disposed at one side of the ice making vessel configured to store the driver and various circuit components, wherein the circuit components are molded so as to prevent water from being introduced into the control box from outside; and a display panel permanently installed at a front side of the ice making vessel configured to display an ice making operation.

* * * * *